US012061013B2

(12) United States Patent
Lin et al.

(10) Patent No.: US 12,061,013 B2
(45) Date of Patent: Aug. 13, 2024

(54) ANTI-SPLASH STRUCTURE AND HUMIDIFICATION APPARATUS

(71) Applicant: Gree Electric Appliances, Inc. of Zhuhai, Guangdong (CN)

(72) Inventors: Zhenhua Lin, Guangdong (CN); Wei Wang, Guangdong (CN); Jianfei Hou, Guangdong (CN); Jianhua Zhang, Guangdong (CN); Bowen Zheng, Guangdong (CN); Shuntian Huo, Guangdong (CN); Zhirong Lin, Guangdong (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 951 days.

(21) Appl. No.: 16/330,636

(22) PCT Filed: Jul. 20, 2017

(86) PCT No.: PCT/CN2017/093594
§ 371 (c)(1),
(2) Date: Mar. 5, 2019

(87) PCT Pub. No.: WO2018/113287
PCT Pub. Date: Jun. 28, 2018

(65) Prior Publication Data

US 2021/0293424 A1 Sep. 23, 2021

(30) Foreign Application Priority Data

Dec. 21, 2016 (CN) ..... 201611191699.X

(51) Int. Cl.
*F24F 6/02* (2006.01)
*F24F 6/00* (2006.01)

(52) U.S. Cl.
CPC ..... *F24F 6/025* (2013.01); *F24F 2006/008* (2013.01)

(58) Field of Classification Search
CPC ..... F24F 6/025; F24F 2006/008; F24F 6/08; F24F 13/00
See application file for complete search history.

(56) References Cited

U.S. PATENT DOCUMENTS 3,325,976 A * 6/1967 West ..... B05B 17/0615 96/348
3,729,138 A * 4/1973 Tysk ..... B05B 17/0607 366/124

(Continued)

FOREIGN PATENT DOCUMENTS

CN 201254069 Y 6/2009
CN 102589075 A * 7/2012

(Continued)

OTHER PUBLICATIONS

The extended European search report for Application No. 17882968.5, dated Jun. 19, 2020, European Patent Office, Germany (8 pages).

(Continued)

*Primary Examiner* — Stephen Hobson
(74) *Attorney, Agent, or Firm* — McAndrews, Held & Malloy, Ltd.

(57) ABSTRACT

Some embodiments of the present disclosure provide an anti-splash structure and a humidification apparatus. The anti-splash structure is provided between a mist outlet (111) and a water storage reservoir (101) of the humidification apparatus, and includes a mist-guiding passage (1) configured to connect the mist outlet (111) and the water storage reservoir (101); a water blocking structure is provided in the mist-guiding passage (1); and the water blocking structure is (Continued)

located at a position opposite to the mist outlet (111) and an opening of the water storage reservoir (101).

4 Claims, 5 Drawing Sheets

(56) References Cited

U.S. PATENT DOCUMENTS 3,774,602 A * 11/1973 Edwards ..... A61M 15/0085 128/200.16
3,788,543 A * 1/1974 St. Amand ..... A01G 15/00 239/14.1
4,087,495 A * 5/1978 Umehara ..... F24F 6/12 261/119.1
4,708,826 A * 11/1987 Mizoguchi ..... F24F 6/12 239/338
4,752,422 A * 6/1988 Uchida ..... B05B 17/0615 261/DIG. 65
5,067,169 A * 11/1991 Chiu ..... F24F 6/025 392/394
5,108,663 A * 4/1992 Chiu ..... F24F 6/043 261/107
5,195,515 A * 3/1993 Levine ..... A61M 16/167 128/203.26
5,217,165 A * 6/1993 Takahashi ..... B05B 17/0615 261/81
5,343,551 A * 8/1994 Glucksman ..... F24F 6/025 261/DIG. 65
5,361,989 A * 11/1994 Merchat ..... B05B 17/0615 239/524
5,464,572 A * 11/1995 Bonzi ..... B05B 17/0669 361/231
5,970,211 A * 10/1999 Ritsher ..... F24F 6/12 392/405
6,019,355 A * 2/2000 Birdsell ..... F24F 1/04 261/DIG. 65
9,776,144 B1 * 10/2017 Lu ..... F24F 11/0008
10,571,138 B2 * 2/2020 Chiu ..... F24F 6/02
10,946,115 B2 * 3/2021 Chiu ..... F24F 6/02
2002/0085839 A1 * 7/2002 Glucksman ..... F24F 6/025 392/394
2003/0042629 A1 * 3/2003 Eom ..... F24F 6/12 261/142
2005/0116059 A1 * 6/2005 Lin ..... B05B 17/0615 239/289
2005/0258554 A1 * 11/2005 Bachert ..... F24F 6/043 261/36.1
2006/0118977 A1 * 6/2006 Huang ..... F24F 6/00 261/DIG. 65
2006/0213508 A1 * 9/2006 Murray ..... B05B 17/0615 128/200.16
2006/0249144 A1 * 11/2006 DeHaan ..... B05B 17/0615 128/200.14
2007/0035044 A1 * 2/2007 Chiu ..... B05B 17/0615 261/81
2007/0278702 A1 * 12/2007 French ..... F24F 6/02 261/81
2008/0223953 A1 * 9/2008 Tomono ..... A61M 11/005 128/200.16
2010/0133162 A1 * 6/2010 Huang ..... F24F 6/12 210/206
2011/0147482 A1 * 6/2011 Matsuura ..... B01D 1/14 239/102.1
2012/0222548 A1 * 9/2012 Lev ..... F24F 6/12 261/119.1
2013/0300005 A1 * 11/2013 Hou ..... F24F 6/12 261/24
2013/0330238 A1 * 12/2013 Lee ..... F24F 8/167 422/123
2015/0223660 A1 * 8/2015 Scholten ..... A47L 11/4086 261/78.2
2016/0356514 A1 * 12/2016 Cai ..... F24F 13/20
2017/0082306 A1 * 3/2017 Murakami ..... F24F 6/00
2019/0049133 A1 * 2/2019 Cai ..... A61L 9/015
2019/0072289 A1 * 3/2019 Lai ..... B01F 23/20
2019/0249888 A1 * 8/2019 Chiu ..... A61L 9/14
2019/0299230 A1 * 10/2019 Song ..... B05B 7/2429
2019/0301756 A1 * 10/2019 Luo ..... F24F 8/30
2020/0139387 A1 * 5/2020 Song ..... B05B 7/0815
2020/0368383 A1 * 11/2020 Feng ..... A61M 11/005
2020/0370769 A1 * 11/2020 Yang ..... F24F 6/12
2021/0389020 A1 * 12/2021 Zhang ..... F24F 6/12
2022/0003454 A1 * 1/2022 Wang ..... G10K 11/162
2022/0048794 A1 * 2/2022 Zhang ..... F24F 11/0008

FOREIGN PATENT DOCUMENTS

CN 102589075 A 7/2012
CN 102095235 A 2/2013
CN 202860748 U 4/2013
CN 104197459 A 12/2014
CN 204100467 U 1/2015
CN 104776540 A * 7/2015
CN 104776540 A 7/2015
CN 104964407 A 10/2015
CN 205261826 U 5/2016
CN 106500228 A 3/2017
CN 206387053 U 8/2017
CN 104776540 B * 12/2017
CN 209857306 U * 12/2019
DE 3141596 A1 7/1982
EP 1055431 A2 11/2000
EP 2278232 A2 1/2011
JP 2007162997 A 6/2007
KR 20050047941 A 5/2005
KR 100836684 B1 6/2008
WO WO-2013163894 A1 * 11/2013 ..... F24F 6/02
WO WO-2019011146 A1 * 1/2019 ..... B05B 1/002
WO WO-2020073725 A1 * 4/2020 ..... F24F 13/00

OTHER PUBLICATIONS

Chinese search report dated Aug. 26, 2021 in Chinese application No. 201611191699X (3 pages).
International Search Report, with a mailing date of Oct. 25, 2017, in International application No. PCT/CN2017/093594, filed on Jul. 20, 2017.

* cited by examiner

ANTI-SPLASH STRUCTURE AND HUMIDIFICATION APPARATUS

This application is a 371 of International Patent Application No. PCT/CN2017/093594, filed Jul. 20, 2017, which claims benefit of Chinese Patent Application No. 201611191699.X, filed to the China Patent Office on Dec. 21, 2016, entitled "Anti-Splash Structure and Humidification Apparatus," contents of both of which are hereby incorporated by reference in their entirety.

TECHNICAL FIELD

The present disclosure relates to a field of humidification, and in particular to an anti-splash structure and a humidification apparatus.

BACKGROUND

A water storage reservoir of a related humidifier is of an open structure, and is opposite to a mist outlet of the humidifier. When the humidifier tiles or tips over, the water in the water storage reservoir easily splashes out of the mist outlet, thereby causing inconvenience to a user; and particularly, when the humidifier is a heating type humidifier, a temperature of the water in the water storage reservoir is high, and it is possible that the hot water splashes out to scald the user; therefore, the related humidifier has a potential safety hazard.

SUMMARY

Some embodiments of the present disclosure provide an anti-splash structure and a humidification apparatus that effectively prevents the water from splashing out and has good use safety.

To this end, some embodiments of the present disclosure provide an anti-splash structure.

An anti-splash structure is provided between a mist outlet and a water storage reservoir of a humidification apparatus, and includes a mist-guiding passage configured to connect the mist outlet and the water storage reservoir; a water blocking structure is provided in the mist-guiding passage; and the water blocking structure is located at a position opposite to the mist outlet and an opening of the water storage reservoir.

In an exemplary embodiment, a water storage space is provided on a sidewall of the mist-guiding passage; and when the humidification apparatus tilts over, water in the water storage reservoir can enter the water storage space under a flow diversion effect of the water blocking structure.

In an exemplary embodiment, the water blocking structure includes a first baffle plate; and the first baffle plate is located at the position opposite to the mist outlet and the opening of the water storage reservoir.

In an exemplary embodiment, one end, close to the water storage reservoir, of the mist-guiding passage is provided with a first end plate; a first port corresponding to a position of the opening of the water storage reservoir is provided on the first end plate; and the first baffle plate is fixed on the first end plate by a support structure.

In an exemplary embodiment, the support structure includes a plurality of support ribs provided at an edge of the first port; and the plurality of support ribs are distributed at intervals along a circumferential direction of the first port.

In an exemplary embodiment, one surface, close to the water storage reservoir, of the water blocking structure is an arc surface protruded toward a direction of the water storage reservoir.

In an exemplary embodiment, one end, close to the mist outlet, of the mist-guiding passage is provided with a second end plate; a second port corresponding to a position of the mist outlet is provided on the second end plate; a size of the second port is smaller than a size of an outline of the second end plate; and the second end plate is formed into the water storage space with the sidewall of the mist-guiding passage.

In an exemplary embodiment, a second baffle plate extending toward a direction of the water storage reservoir is provided at an edge of the second port; and the second end plate, the second baffle plate and the sidewall of the mist-guiding passage are enclosed into the water storage space.

In an exemplary embodiment, the second baffle plate is enclosed into a cylindrical structure at the edge of the second port.

In an exemplary embodiment, a connecting structure is provided on the anti-splash structure, and is configured to mount the anti-splash structure onto the humidification apparatus.

In an exemplary embodiment, a switch apparatus is provided on the anti-splash structure; and the switch apparatus is configured to be capable of switching on a circuit of the humidification apparatus when the anti-splash structure is mounted on the humidification apparatus in place.

According to a second aspect, an embodiment of the present disclosure provides a humidification apparatus.

A humidification apparatus includes the above-mentioned anti-splash structure.

In an exemplary embodiment, the humidification apparatus further includes a pedestal, and a box body mounted on the pedestal; the water storage reservoir is formed by sinking on the pedestal; the mist outlet is formed at a position, corresponding to an opening of the water storage reservoir, on a top of the box body; and the anti-splash structure is mounted on the pedestal and is located in the box body.

In an exemplary embodiment, the anti-splash structure is mounted on the pedestal by a connecting structure in a rotational manner.

The connecting structure includes a bump provided on one of the anti-splash structure and the pedestal, and a mounting groove provided on the other of the anti-splash structure and the pedestal; the mounting groove includes an inlet section and a rotary section connected with the inlet section; and the bump can enter the mounting groove from the inlet section, and is slid along the rotary section to mount the anti-splash structure on the pedestal.

In an exemplary embodiment, the humidification apparatus includes a heating component, configured to heat water in the water storage reservoir.

The anti-splash structure provided by the present disclosure is provided with the water blocking structure at the position, opposite to the moist outlet and the opening of the water storage reservoir, of the humidification apparatus; when the humidification apparatus tilts or tips over, owing to the blocking effect of the water blocking structure, the water in the water storage reservoir does not splash out of the mist outlet directly, and thus the water in the water storage reservoir can be prevented from splashing out to a certain extent to cause inconvenience to a user; and when the humidification apparatus is of a heating type, the use safety of the user can further be guaranteed.

According to the humidification apparatus provided by the present disclosure, because the above anti-splash structure is adopted, the water can be prevented from splashing out of the mist outlet to a certain extent; and therefore, the humidification apparatus is convenient for the user to use and the use safety of the humidification apparatus is guaranteed.

BRIEF DESCRIPTION OF THE DRAWINGS

With reference to the description of accompanying drawings on embodiments of the present disclosure, the above and other objectives, characteristics and advantages of the present disclosure will become apparent. In the drawings.

Figure 1:
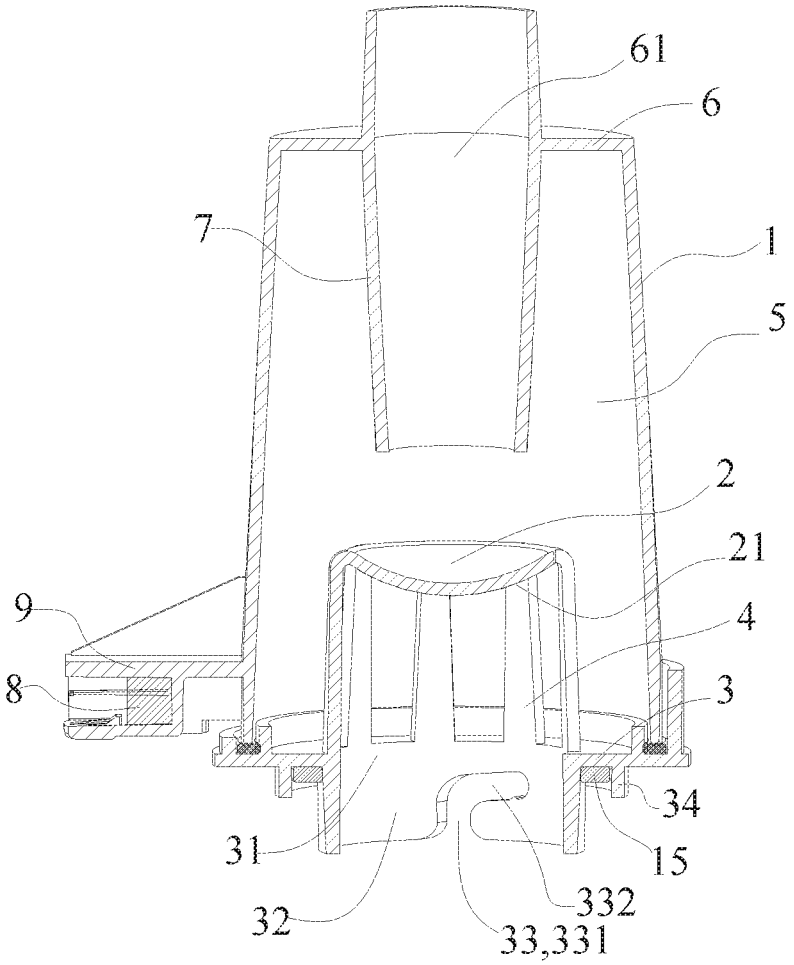
FIG. 1 illustrates a sectional view of an anti-splash structure provided by a specific embodiment of the present disclosure.

In the drawings, 1: mist-guiding passage; 2: first baffle plate; 21: arc surface; 3: first end plate; 31: first port; 32: cylindrical structure; 33: mounting groove; 331: inlet section; 332: rotary section; 34: limit block; 4: support rib; 5: water storage space; 6: second end plate; 61: second port; 7: second baffle plate; 8: switch apparatus; 9: mounting bracket; 10: pedestal; 101: water storage reservoir; 102: bump; 11: box body; 111: mist outlet; 12: cylindrical structure; 13: water tank structure; 14: heating component; 15: sealing ring; 16: anti-splash structure.

DETAILED DESCRIPTION OF THE EMBODIMENTS

The present disclosure will be described below based on the embodiments. However, the present disclosure is not merely limited to these embodiments. Some particular detail portions are described in detail in the following detailed description of the present disclosure. A person skilled in the art may also completely understand the present disclosure if there is no description on these detail portions. In order to avoid confusing the essence of the present disclosure, well-known method, process, procedure and element are not described in detail.

In addition, a person of ordinary skill in the art should understand that the accompanying drawings provided herein are merely for illustration, and the accompanying drawings are unnecessarily drawn proportionally.

Unless otherwise specified explicitly herein, words such as "include" and "comprise" in the whole specification and claims should be understood as a meaning of inclusion rather than an exclusive or exhaustive meaning, i.e., an "include but not limited to" meaning.

In the description of some embodiments of the present disclosure, it should be understood that the terms "first" and "second" are merely for description and cannot be understood as indicating or implying a relative importance. Besides, in the description of the present disclosure, unless otherwise stated, "a plurality of" means two or more.

Figure 3:
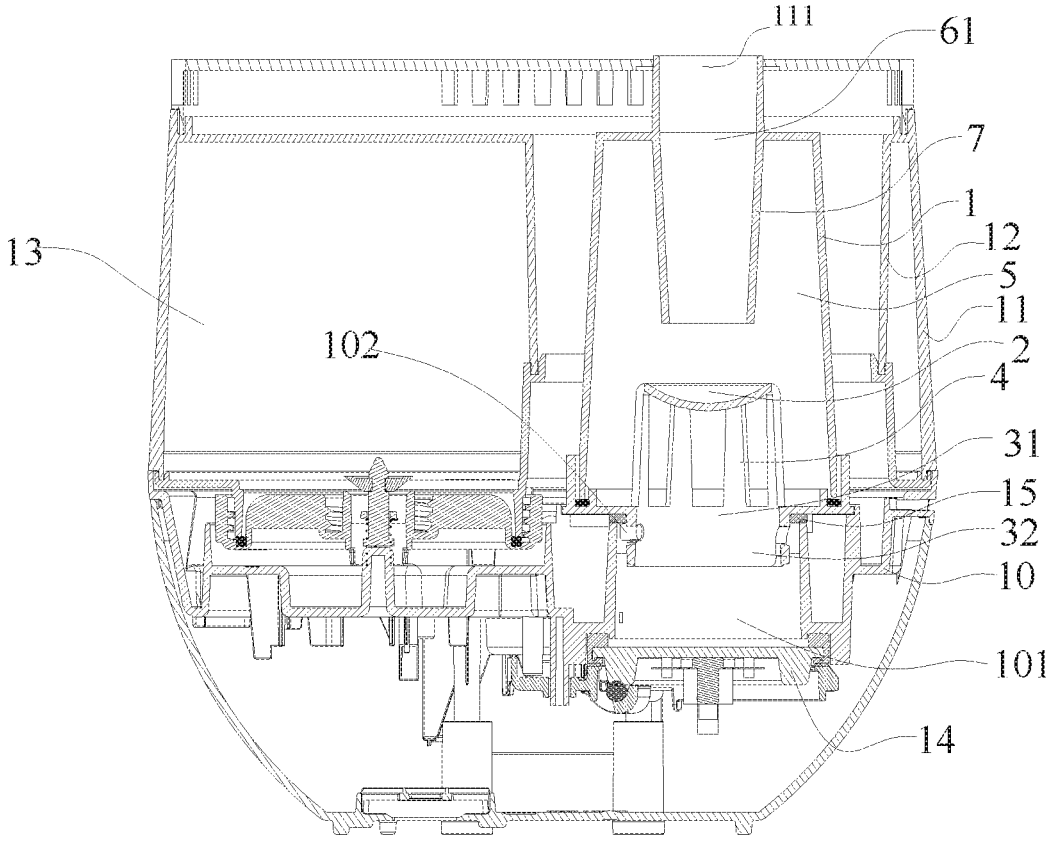
FIG. 3 illustrates a sectional view of a humidification apparatus provided by a specific embodiment of the present disclosure.

In some embodiments of the present disclosure, "upper", "lower" and "top" are orientations when the humidification apparatus is used normally and may be referred to the orientations indicated in FIG. 3.

Figure 2:
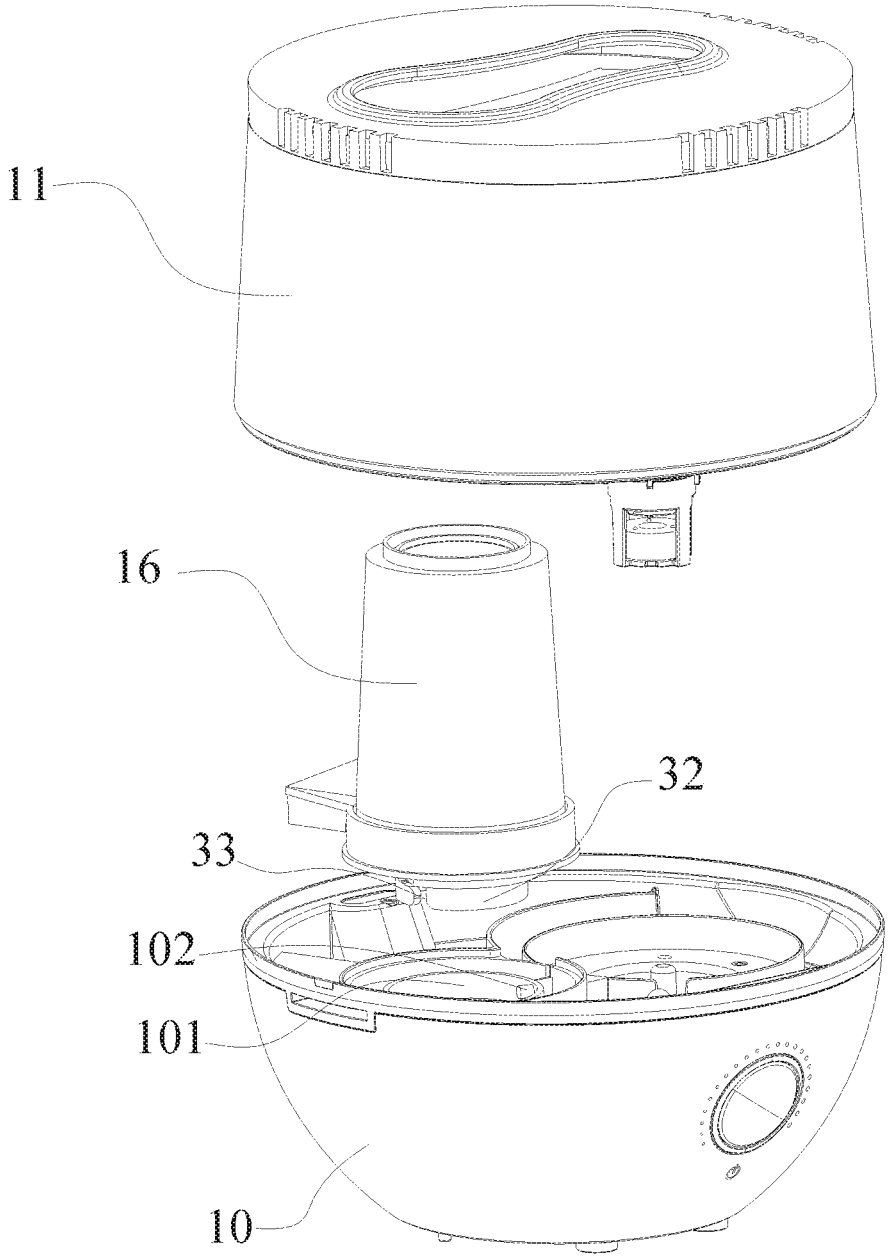
FIG. 2 illustrates an exploded view of a humidification apparatus provided by a specific embodiment of the present disclosure.

Some embodiments of the present disclosure provide an anti-splash structure and a humidification apparatus provided with the anti-splash structure. As shown in FIG. 1 to FIG. 3, the anti-splash structure is provided between a mist outlet 111 and a water storage reservoir 101 of the humidification apparatus, and the blocking effect is formed by a water blocking structure disposed at a position opposite to the mist outlet 111 and the water storage reservoir 101. When the humidification apparatus tilts or tips over, the water in the water storage reservoir 101 does not splash out of the mist outlet 111 directly, and thus the water in the water storage reservoir 101 can be prevented from splashing out to a certain extent to cause inconvenience to a user; and when the humidification apparatus is of a heating type, an use safety of the user can further be guaranteed.

In an exemplary embodiment, the anti-splash structure includes a mist-guiding passage 1 configured to connect the mist outlet 111 and the water storage reservoir 101, and the water blocking structure is provided in the mist-guiding passage 1. A specific shape of the mist-guiding passage 1 is not limited, provided that a passage for water mist can be formed and vapor formed at the water storage reservoir 101 is discharged from the humidification apparatus by the mist-guiding passage 1 and the mist outlet 111. For example, the mist-guiding passage 1 may be of a cylindrical shape shown in FIG. 1.

A specific structure of the water blocking structure is not limited provided that the effect of blocking the water can be implemented and the water in the water storage reservoir 101 is prevented from directly rushing out of the mist outlet 111. In an exemplary embodiment, as shown in FIG. 1, the water blocking structure includes a first baffle plate 2. As shown in FIG. 3, the first baffle plate 2 is located at a position opposite to the mist outlet 111 and an opening of the water storage reservoir 101. Certainly, an outline of the first baffle plate 2 may also beyond the position opposite to the mist outlet 111 and the opening of the water storage reservoir 101 provided that a position for passing through the water mist can be reserved. A specific shape of the first baffle plate 2 is not limited, and may be, for example, a circle, a triangle, a rectangle, a polygon, etc. In an exemplary embodiment, the first baffle plate 2 is provided into a circle adapted to the mist outlet 111 and the opening of the water storage reservoir 101.

In an exemplary embodiment, in order to fix the first baffle plate 2 conveniently, one end, close to the water storage reservoir 101, of the mist-guiding passage 1 is provided with a first end plate 3; a first port 31 corresponding to a position of the opening of the water storage reservoir 101 is provided on the first end plate 3; and the first baffle plate 2 is fixed on the first end plate 3 by a support structure. A specific form of the support structure is not limited provided that a specific function of the first baffle plate 2 can be implemented. In addition, with the support structure, a blocking effect can further be formed for water rushed out of the water storage reservoir 101. In an exemplary embodiment, the support structure includes a plurality of support ribs 4 provided at an edge of the first port 31; and the plurality of support ribs 4 are distributed at intervals along a circumferential direction of the first port 31, so as to support and fix the first baffle plate 2 on one hand; and on the other hand, the support ribs 4 distributed along the circumferential direction can also form a blocking effect to the water, thereby further improving the anti-splash effect. In order to improve the structural reliability of the support ribs 4 and the fixing reliability of the first baffle plate 2, widths of the support ribs 4 towards a direction of the first baffle plate 2 are gradually reduced.

In an exemplary embodiment, one surface, close to the water storage reservoir 101, of the water blocking structure is an arc surface 21 protruded toward a direction of the water storage reservoir 101, thereby guiding the water rushed out of the water storage reservoir 101 and buffering the water on one hand. On the other hand, the water is moved toward the sidewall of the mist-guiding passage 1 under a flow diversion effect of the arc surface 21, thereby improving the anti-splash effect. In an exemplary embodiment, as shown in FIG. 1, the water blocking structure is of an arc platy structure protruded toward the direction of the water storage reservoir 101 and is similar to a bowl shape.

In an exemplary embodiment, a water storage space 5 is provided on a sidewall of the mist-guiding passage 1. When the humidification apparatus tilts over, the water in the water storage reservoir 101 can enter the water storage space 5 under the flow diversion effect of the water blocking structure; and a storage space is provided by the water storage space 5 for the water flowed out of the water storage reservoir 101, thus further preventing the water from directly splashing out of the mist outlet 111.

A forming manner of the water storage space 5 is not limited specifically provided that the water enters the water storage space 5 under the flow diversion of the water blocking structure. For example, in one embodiment, the sidewall of the mist-guiding passage is sunken to form a concave portion and the concave portion is formed into the water storage space. In another embodiment, as shown in FIG. 1, one end, close to the mist outlet 111, of the mist-guiding passage 1 is provided with a second end plate 6; a second port 61 corresponding to the position of the mist outlet 111 is provided on the second end plate 6; a size of the second port 61 is smaller than a size of an outline of the second end plate 6; and thus the second end plate 6 is formed into the water storage space 5 with the sidewall of the mist-guiding passage 1. When the humidification structure provided with the anti-splash structure tilts over with a small angle (within 90°), the water in the water storage reservoir 101 can enter the water storage space 5 under the action of the water blocking structure.

In an exemplary embodiment, a second baffle plate 7 extending toward the direction of the water storage reservoir 101 is provided at an edge of the second port 61; and thus the second end plate 6, the second baffle plate 7 and the sidewall of the mist-guiding passage 1 are enclosed into the water storage space 5. With the blocking effect of the second baffle plate 7, the anti-splash effect can further be improved. A specific structure of the second baffle plate 7 is not limited. In an exemplary embodiment, the second baffle plate 7 at the edge of the second port 61 is enclosed into a cylindrical structure, a lower port of the cylindrical structure is opposite to the first baffle plate 2, and in an exemplary embodiment, a diameter of the lower port is smaller than an outer diameter of the first baffle plate 2. In this way, even though the humidification apparatus tilts over with a large angle (greater than 90°), the water in the water storage reservoir 101 is also flowed to the water storage space 5 enclosed by the second baffle plate 7 with the cylindrical structure, the second end plate 6 and the sidewall of the mist-guiding passage 1 under the guiding effect of the first baffle plate 2. In an exemplary embodiment, in order to increase the volume of the water storage space 5 and prevent the water in the water storage reservoir 101 from entering the second baffle plate 7 of the cylindrical structure, the second baffle plate 7 of the cylindrical structure is of a conical structure of which the size is shrunk gradually toward a direction of the first baffle plate 2.

In an exemplary embodiment, the sidewall of the mist-guiding passage 1 is obliquely provided, so that the sidewall of the mist-guiding passage 1 is tiled over gradually toward a radial outside from a direction of the water storage reservoir 101 to a direction of the mist outlet 111. The sidewall provided obliquely can guide the water to a certain extent, so that the water is flowed to the direction of the water storage reservoir 101 as much as possible.

In an exemplary embodiment, a connecting structure is provided on the anti-splash structure, and is configured to mount the anti-splash structure onto the humidification apparatus. A specific structure of the connecting structure is not limited provided that the anti-splash structure can be mounted conveniently and reliably (which will be described hereinafter).

In an exemplary embodiment, a switch apparatus 8 is provided on the anti-splash structure; and after the anti-splash structure 16 is mounted on the humidification apparatus in place, the switch apparatus 8 can switch on a circuit of the humidification apparatus. If no anti-splash structure is mounted, the humidification apparatus cannot be started, and thus the use safety of the humidification apparatus is improved. A specific structure of the switch apparatus 8 is not limited, and in an exemplary embodiment, the switch apparatus 8 is a proximity switch. The switch apparatus 8 is structured simply and is provided conveniently. A specific position of the switch apparatus 8 is not limited provided that it can be matched with a structure on the humidification apparatus to implement the above function. For example, in the embodiment shown in FIG. 1, a mounting bracket 9 is provided on an outer sidewall of the mist-guiding passage 1, and the switch apparatus 8 is provided on the mounting bracket 9.

In an exemplary embodiment, the first end plate 3, the mist-guiding passage 1 and the second end plate 6 may be of an integrally moulded structure, and may also be of a split structure for the purpose of machining and assembling conveniently, and are assembled together by a clamping structure, a splicing structure and the like. When the split structure is provided, a sealing structure is provided at a junction of each component so as to guarantee the sealing effect of the anti-splash structure.

In an exemplary embodiment, a humidification apparatus provided by the present disclosure includes the above-mentioned anti-splash structure. In a structure of the humidification apparatus, as shown in FIG. 2 and FIG. 3, the humidification apparatus includes a pedestal 10 and a box body 11 mounted on the pedestal 10; a water storage reservoir 101 is formed by sinking on the pedestal 10; a mist outlet 111 is formed at a position, corresponding to an opening of the water storage reservoir 101, on a top of the box body 11; and the anti-splash structure 16 is mounted on the pedestal 10 and is located in the box body 11. In order to conveniently mount the anti-splash structure 16, a cylindrical structure 12 is provided in the box body 11; the box body 11 and an outer wall of the cylindrical structure 12 are enclosed into a water tank structure 13 for storing water; a top of the cylindrical structure 12 is corresponding to the position of the mist outlet 111, and a bottom of the cylindrical structure 12 is corresponding to the position of the opening of the water storage reservoir 101; and the anti-splash structure 16 is provided in the cylindrical structure 12. A water draining apparatus is provided under the water tank structure 13. When the box body 11 is mounted on the pedestal 10, the water draining apparatus can open the water tank structure 13, and the water in the water tank structure 13 can be flowed to the water storage reservoir 101. A heating component 14 is provided at a bottom of the water storage reservoir 101. The water in the water storage reservoir 101 is heated by the heating component 14, so that the water in the water storage reservoir 101 is boiled to generate vapor. Since a gas has a diffusion effect, the vapor can be flowed out by spaces between the support ribs 4 and at last is sprayed out by the second baffle plate 7 with the cylindrical structure and the mist outlet 111 to achieve the humidifying purpose. A specific heating form of the heating component 14 is not limited, and may be, for example, electric heating and is of a disk shape.

Figure 4:
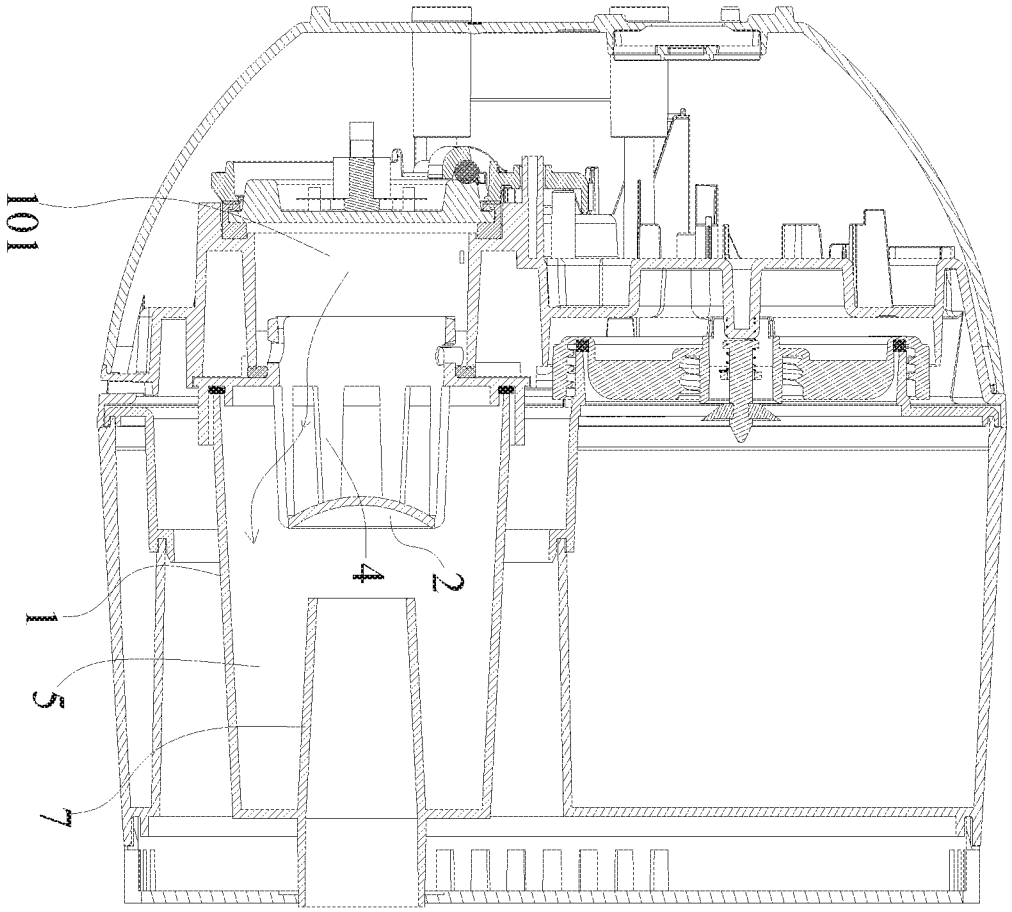
FIG. 4 illustrates a sectional view of a humidification apparatus in a 90° tip-over state provided by an embodiment of the present disclosure.
Figure 5:
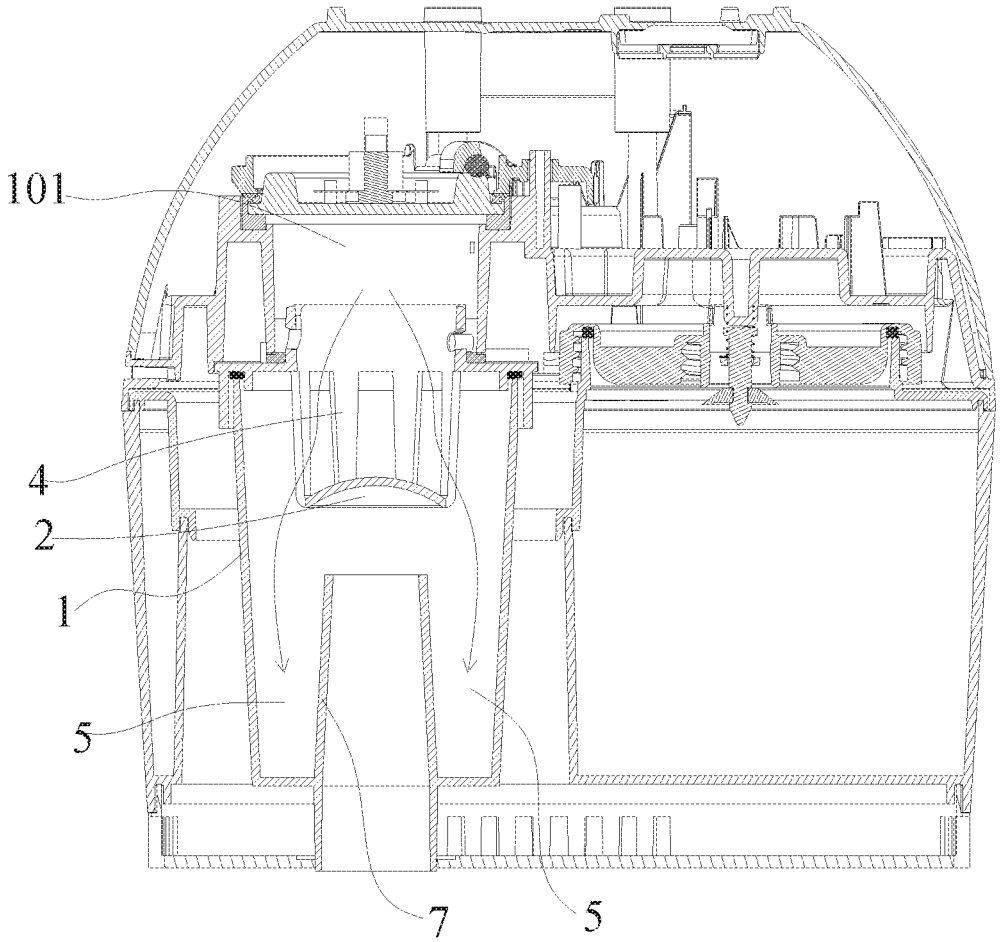
FIG. 5 illustrates a sectional view of a humidification apparatus in a 180° tip-over state provided by a specific embodiment of the present disclosure.

As shown in FIG. 4, when the humidification apparatus tilts over with 90°, the water in the water storage reservoir 101 can enter the water storage space 5 at a side of the mist-guiding passage 1 under an action of the water blocking structure. In an exemplary embodiment, by setting the volume of the water storage space 5 to be greater than the volume of the water storage reservoir 101, the water in the water storage space 5 is prevented from flowing out of the mist outlet 111. As shown in FIG. 5, when the humidification apparatus tilts over with 180°, the water in the water storage reservoir 101 can enter the water storage space 5 between the mist-guiding passage 1 and the second baffle plate 7 with the cylindrical structure under the action of the water blocking structure. In an exemplary embodiment, by setting the volume of the water storage space 5 to be greater than the volume of the water storage reservoir 101, the water in the water storage space 5 is prevented from flowing out to the second baffle plate 7 and flowing out of the mist outlet 111. With a test, when the humidification apparatus tips over, even through the water is flowed out, the temperature of the overflowed water is smaller than 50° C. and thus the use safety of the user can be guaranteed.

A specific connection relationship between the anti-splash structure 16 and the pedestal 10 is not limited. In an exemplary embodiment, the anti-splash structure 13 is mounted on the water storage reservoir 101 of the pedestal 10 by a connecting structure in a rotational manner. In an exemplary embodiment, as shown in FIG. 1, the connecting structure is provided on the first end plate 3 of the anti-splash structure 13. In an exemplary embodiment, a cylindrical structure 32 is extended downward from the first end plate 3. A mounting groove 33 is formed on the cylindrical structure 32. The mounting groove 33 includes an inlet section 331 and a rotary section 332 connected with the inlet section 331. In an exemplary embodiment, the inlet section 331 extends along a vertical direction; one end of the inlet section 331 communicates with an edge of the cylindrical structure 32, and the other end of the inlet section 331 is connected with one end of the rotary section 332. The rotary section 332 extends circumferentially and the other end of the rotary section is sealed. As shown in FIG. 2 and FIG. 3, a bump 102 is provided on an inner wall of the water storage reservoir 101, and the bump 102 is of a cylindrical shape. In this way, during mounting, the inlet section 331 of the anti-splash structure 16 is aligned to the bump 102 to move downward, so that the bump 102 enters the mounting groove 33 from the inlet section 331; then, by rotating the anti-splash structure 16, the bump 102 is slid along the rotary section 332 to the sealed end of the rotary section 332 and thus the anti-splash structure 16 is locked with the pedestal 10. A dismounting process is reverse to the mounting process. The connecting structure is convenient for mounting and dismounting of the anti-splash structure 16 and the structure is simple. In some embodiments, the positions of the mounting groove 33 and the bump 102 may be changed to each other, i.e., the bump is provided on the anti-splash structure, and the mounting groove is formed on the water storage reservoir 101.

Besides, in order to guarantee the sealing in mounting of the anti-splash structure 16, a sealing structure is provided between the anti-splash structure 16 and the water storage reservoir 101. In an exemplary embodiment, the sealing structure is a sealing ring 15 provided on the anti-splash structure 16. Specifically, a limit block 34 is provided at a radial outside of the cylindrical structure 32 of the first end plate 3 of the anti-splash structure 16. In an exemplary embodiment, the limit block 34 is of an annular shape. The sealing ring 15 is provided between the limit block 34 and the cylindrical structure 32. When the anti-splash structure 16 is mounted, a top structure of the water storage reservoir 101 is inserted between the limit block 34 and the cylindrical structure 32.

It is easily understood by the person skilled in the art that the above preferable solution may be combined ad overlapped freely if there is no conflict.

It should be understood that the above embodiments are merely for illustration but not for limitation. On the premise of not departing from the basic principles of the present disclosure, the person skilled in the art may make various obvious or equivalent modifications or replacements for the above details, ad all should be included in a scope of the claims of the present disclosure.

What is claimed is:

1. An anti-splash structure, being provided between a mist outlet and a water storage reservoir of a humidification apparatus, and comprising a mist-guiding passage configured to connect the mist outlet and the water storage reservoir, wherein a water blocking structure is provided in the mist-guiding passage; and the water blocking structure is located at least partially at a position opposite to the mist outlet and at least partially at an opening of the water storage reservoir;

wherein the water blocking structure comprises a first baffle plate; and the first baffle plate is located between the mist outlet and the opening of the water storage reservoir; a first end, close to the water storage reservoir, of the mist-guiding passage is provided with a first end plate; a first port corresponding to a position of the opening of the water storage reservoir is provided on the first end plate; and the first baffle plate is fixed on the first end plate by a support structure; the support structure comprises a plurality of support ribs provided at an edge of the first port; and the plurality of support ribs are distributed at intervals along a circumferential direction of the first port; the first baffle plate is supported and fixed, and the supporting ribs distributed along the circumferential direction can also achieve a certain blocking effect for water, thereby having an anti-splashing effect;

wherein a second end, close to the mist outlet, of the mist-guiding passage is provided with a second end plate; a second port corresponding to a position of the mist outlet is provided on the second end plate; a size of the second port is smaller than a size of an outline of the second end plate; and the second end plate is formed into the water storage space with a sidewall of the mist-guiding passage;

a second baffle plate extending toward a direction of the water storage reservoir is provided at an edge of the second port; and the second end plate, the second baffle plate and the sidewall of the mist-guiding passage are enclosed into the water storage space;

the second baffle plate is configured to be a cylindrical structure at an edge of the second port; wherein the cylindrical structure is capable of having a blocking effect;

the cylindrical structure is of a conical structure of which the size is shrunk gradually toward a direction of the first baffle plate;

wherein one surface, close to the water storage reservoir, of the water blocking structure is an arc surface protruded toward a direction of the water storage reservoir; the first end plate, the mist-guiding passage and the second end plate are of an integrally moulded structure.

2. The anti-splash structure as claimed in claim 1, wherein a water storage space is provided on the sidewall of the mist-guiding passage; and when the humidification apparatus tilts over, water in the water storage reservoir can enter the water storage space under a flow diversion effect of the water blocking structure.

3. The anti-splash structure as claimed in claim 1, wherein a connecting structure is provided on the anti-splash structure, and the connecting structure is configured to mount the anti-splash structure onto the humidification apparatus.

4. The anti-splash structure as claimed in claim 1, wherein a switch apparatus is provided on the anti-splash structure; and the switch apparatus is configured to be capable of switching on a circuit of the humidification apparatus when the anti-splash structure is mounted on the humidification apparatus in place.

* * * * *